US011679295B2

(12) United States Patent
Chen

(10) Patent No.: US 11,679,295 B2
(45) Date of Patent: Jun. 20, 2023

(54) TOWING EQUIPMENT FOR SPORTS

(71) Applicant: JOONG CHENN INDUSTRY CO., LTD., Nantou (TW)

(72) Inventor: James Chen, Nantou (TW)

(73) Assignee: JOONG CHENN INDUSTRY CO., LTD., Nantou (TW)

( * ) Notice: Subject to any disclaimer, the term of this patent is extended or adjusted under 35 U.S.C. 154(b) by 0 days.

(21) Appl. No.: 17/163,864

(22) Filed: Feb. 1, 2021

(65) Prior Publication Data

US 2022/0203152 A1 Jun. 30, 2022

(30) Foreign Application Priority Data

Dec. 31, 2020 (TW) ..... 109147132

(51) Int. Cl.

| | |
|---|---|
| ***A63B 21/22*** | (2006.01) |
| ***A63B 21/005*** | (2006.01) |
| ***A63B 21/00*** | (2006.01) |
| ***A63B 21/08*** | (2006.01) |

(52) U.S. Cl.

CPC ..... *A63B 21/22* (2013.01); *A63B 21/0051* (2013.01); *A63B 21/153* (2013.01); *A63B 21/00192* (2013.01); *A63B 21/08* (2013.01)

(58) Field of Classification Search

CPC . A63B 21/0618; A63B 21/065; A63B 21/068; A63B 21/08; A63B 21/00192; A63B 21/05; A63B 21/0059; A63B 21/02; A63B 21/04; A63B 21/0442; A63B 21/055; A63B 21/0557; A63B 21/4001; A63B 21/4007; A63B 21/0051; A63B 21/153; A63B 23/047; A63B 21/22; A63B 21/225; A63B 21/4011; A63B 21/4013;

(Continued)

(56) References Cited

U.S. PATENT DOCUMENTS 6,857,993 B2 * 2/2005 Yeh ..... A63B 21/005 482/92

7,314,434 B2 * 1/2008 Chen ..... A63B 21/0051 188/164

(Continued)

FOREIGN PATENT DOCUMENTS

CN 207722280 U 8/2018

*Primary Examiner* — Megan Anderson

(74) *Attorney, Agent, or Firm* — Muncy, Geissler, Olds & Lowe, P.C.

(57) ABSTRACT

A towing equipment used to train athletes' speed, strength and agility is disclosed to include a training unit, a magnetic resistance unit and a transmission mechanism. By an elastic training belt of the training unit, the towing equipment is connected to the human body. The kinetic energy generated by the human body pulling the elastic training belt is transmitted to the magnetic resistance unit through the transmission mechanism to generate resistance. The magnetic resistance unit includes a magnetic device set and an adjustment device set. The user can adjust the resistance generated by the magnetic device set through the adjustment device set. The magnetic device set includes a resistance wheel set on the frame body and a bearing block set corresponding to the resistance wheel. Use the overlap area of a magnetic field in the resistance wheel and the bearing block to generate magnetic flux.

9 Claims, 7 Drawing Sheets

(58) Field of Classification Search
CPC ..... A63B 21/4015; A63B 21/4017; A63B 21/4019; A63B 21/4021
See application file for complete search history.

(56) References Cited

U.S. PATENT DOCUMENTS

| | | | | |
|---|---|---|---|---|
| 7,785,236 | B1 * | 8/2010 | Lo | A63B 22/0605 482/57 |
| 8,845,497 | B2 * | 9/2014 | Turner | A63B 21/00069 482/93 |
| 10,486,016 | B2 * | 11/2019 | Robert | A63B 21/153 |
| 11,517,791 | B2 * | 12/2022 | Kuo | A63B 21/151 |
| 2016/0310785 | A1 * | 10/2016 | Lo | A63B 21/015 |
| 2017/0106222 | A1 * | 4/2017 | Mayer | A63B 21/0051 |
| 2019/0054360 | A1 * | 2/2019 | Hawkins, III | A63B 21/00069 |
| 2019/0299053 | A1 * | 10/2019 | Friedman | A63B 21/0051 |

* cited by examiner

TOWING EQUIPMENT FOR SPORTS

BACKGROUND OF THE INVENTION

1. Field of the Invention

The present invention relates to a sports equipment, and more particularly, to a towing equipment using a magnetic resistance control system.

2. Description of the Related Art

For athletes, resistance training is aimed at athletes' speed, strength and agility. By connecting the fixing device worn on the athlete to a resistance device, the training effect is improved by the horizontal damping force of the resistance device in the opposite direction. China's CN207722280 utility model discloses a use of sandbags to feel pressure on the user during the middle and late stages of training, so that the muscles can achieve the best training. However, the number of sandbags that can be stored in these training devices is limited, which cannot provide users with higher-intensity training. It mainly focuses on the physical training of sprinters, and does not strengthen other types of sports such as basketball players' strength and agility training.

A conventional friction resistance device can effectively provide weight training for athletes. The friction resistance device comprises a training wheel and a training rope. The training rope connects the human body with the resistance device. When the athlete moves in the opposite direction of the resistance device, the resistance effect is achieved by adjusting the friction between a flywheel and a friction plate of the resistance device. However, after a period of use, the friction effect will be reduced due to the wear of the friction plate, and noise will be generated during friction, so there is still room for improvement.

SUMMARY OF THE INVENTION

The present invention has been accomplished under the circumstances in view. It is the main object of the present invention to provide a towing equipment for sports, which can omit the step of replacing the friction plate of the friction resistance device after a period of time, thereby increasing the service life of the equipment and solving the problem of easy noise generation.

To achieve this and other objects of the present invention, a towing equipment for sports generally comprises a support frame, a training unit, a magnetic resistance unit and a transmission mechanism. The support frame comprises a base and a frame body vertically connected to the base. The training unit is set in the frame body. The training unit comprises a training wheel and an elastic training belt. The elastic training belt has one end thereof wound on the training wheel and an opposite end thereof connectable to the user. The transmission mechanism is set in the frame body to connect the training unit and the magnetic resistance unit. The magnetic resistance unit comprises a magnetic device set and an adjustment device set. The magnetic device set comprises a resistance wheel, a bearing block and a set of magnets. The resistance wheel is set in the frame body. The bearing block is set corresponding to the resistance wheel. The bearing block accommodates the set of magnets. The set of magnet forms a magnetic field. The adjustment device set us connected to the magnetic device set and used to change the overlap area between the resistance wheel and the bearing block. The kinetic energy generated by the user pulling the elastic training belt is transmitted to the resistance wheel through the transmission mechanism, and a resistance is generated by the magnetic field that cuts through the bearing block when the resistance wheel rotates.

It can be seen from the above structure, the towing equipment uses the transmission mechanism to transmit the kinetic energy generated by the training unit to the magnetic resistance unit. Through the rotation of the resistance wheel of the magnetic resistance unit, the magnetic field of the bearing block is cut to generate resistance, and the resistance is controlled by the adjustment device set, thereby increasing the service life of the towing equipment.

Preferably, the adjustment device set of the magnetic resistance unit comprises an adjustment member, an elastic member and a driving member. The adjustment member is connected with the elastic member. The driving member is connected between the elastic member and the bearing block. The elastic member drives the driving member to adjust the correspondence between the bearing block and the resistance wheel by means of adjusting the adjustment member to stretch or compress the elastic member.

Preferably, the adjustment device set further comprises a sliding groove adjacent to the bearing block and a clamping portion. The clamping portion is set between the bearing block and the sliding groove. The clamping portion is clamped to the sliding groove, so that the bearing block is moved back and forth on the sliding groove when the bearing block is driven by the driving member.

Preferably, the resistance wheel is made of a magnetic material.

Preferably, the transmission mechanism comprises a first transmission wheel, a second transmission wheel, a first shaft, a second shaft and a transmission member. The first transmission wheel and the training wheel are co-located on the first shaft. The second shaft is the common rotating shaft of the second transmission wheel and the resistance wheel. The first transmission wheel is connected to the second transmission wheel through the transmission member.

Preferably, the transmission mechanism further comprises a press roller adjacent to the second transmission wheel for controlling the tension of the transmission member.

Preferably, the training unit further comprises a control wheel set mounted in the frame body. The elastic training belt passes through the control wheel set after being pulled out from the training wheel.

Preferably, the frame body is provided with a screen display that is used to display resistance value, heartbeat index and sprint speed.

Preferably, the base has one side thereof equipped with at least one moving wheel to facilitate the movement of the towing equipment.

Preferably, the support frame has one side thereof equipped with a dumbbell rack.

The detailed structure, characteristics, assembly or use of the towing equipment for sports provided by the present invention will be described in the detailed description of the subsequent preferred embodiment. However, those with ordinary knowledge in the field of the present invention should be able to understand that these detailed descriptions and the specific preferred embodiment listed in the implementation of the present invention are only used to illustrate the present invention, and are not intended to limit the scope of the patent application of the present invention.

DETAILED DESCRIPTION OF THE INVENTION

The applicant first explains here, the following is a detailed description of the technical content and features of the present invention by means of the preferred embodiment listed in conjunction with the drawings. Those skilled in the art can understand that the explanatory terms of this embodiment belong to the upper-level description that does not limit the application field. For example, the terms of shape or material include but are not limited to the material or shape specified in the description. In addition, the directional adjectives such as "top, bottom, up, down, inside, and outside" mentioned in the content of this description are only exemplary descriptive terms based on the normal direction of use, and are not intended to limit the scope of claims. Furthermore, in the preferred embodiment and drawings to be introduced below, the same element numbers represent the same or similar elements or their structural features.

Figure 1:
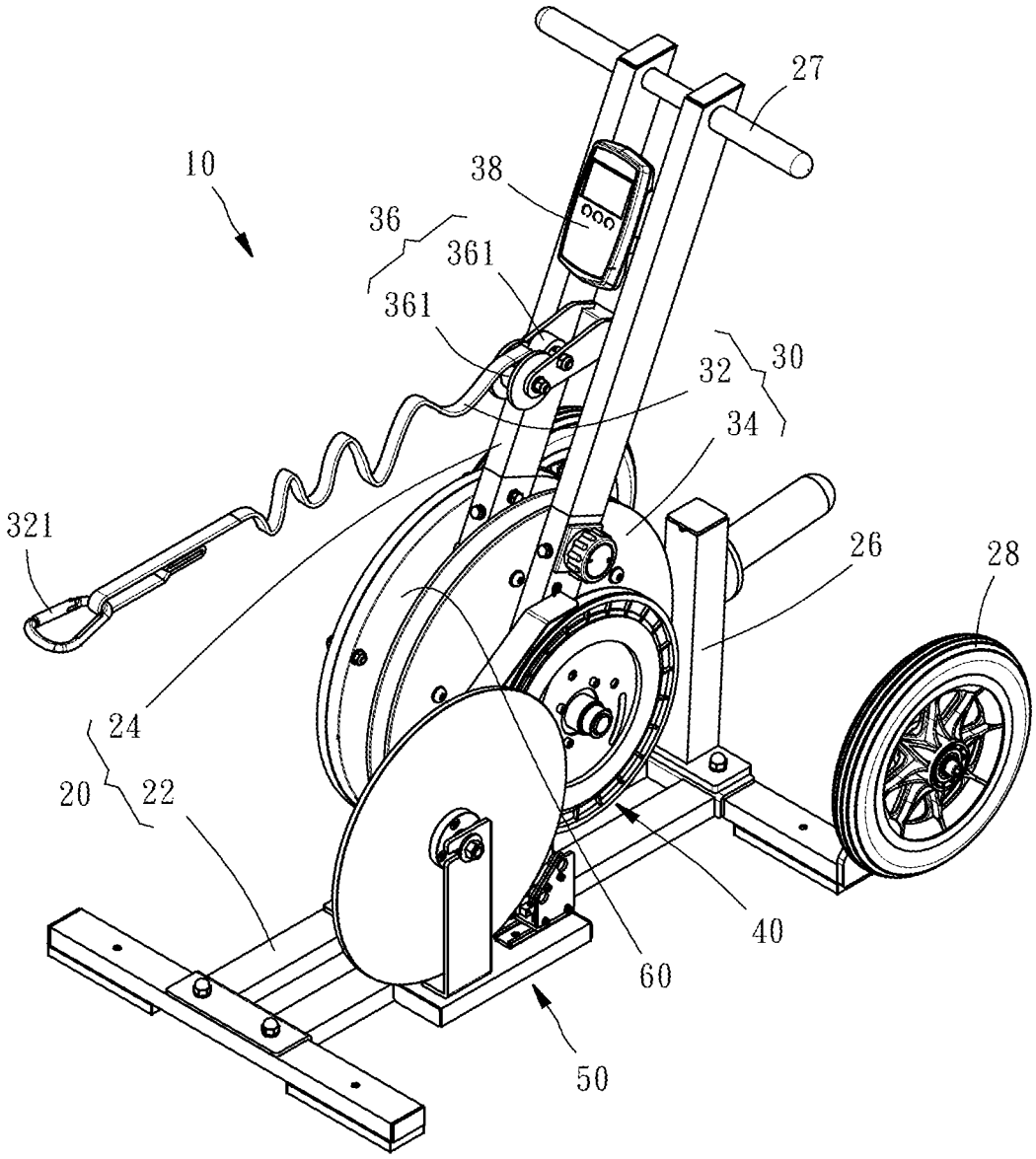
FIG. 1 is an oblique top elevational view of a towing equipment for sports in accordance with the present invention.
Figure 2:
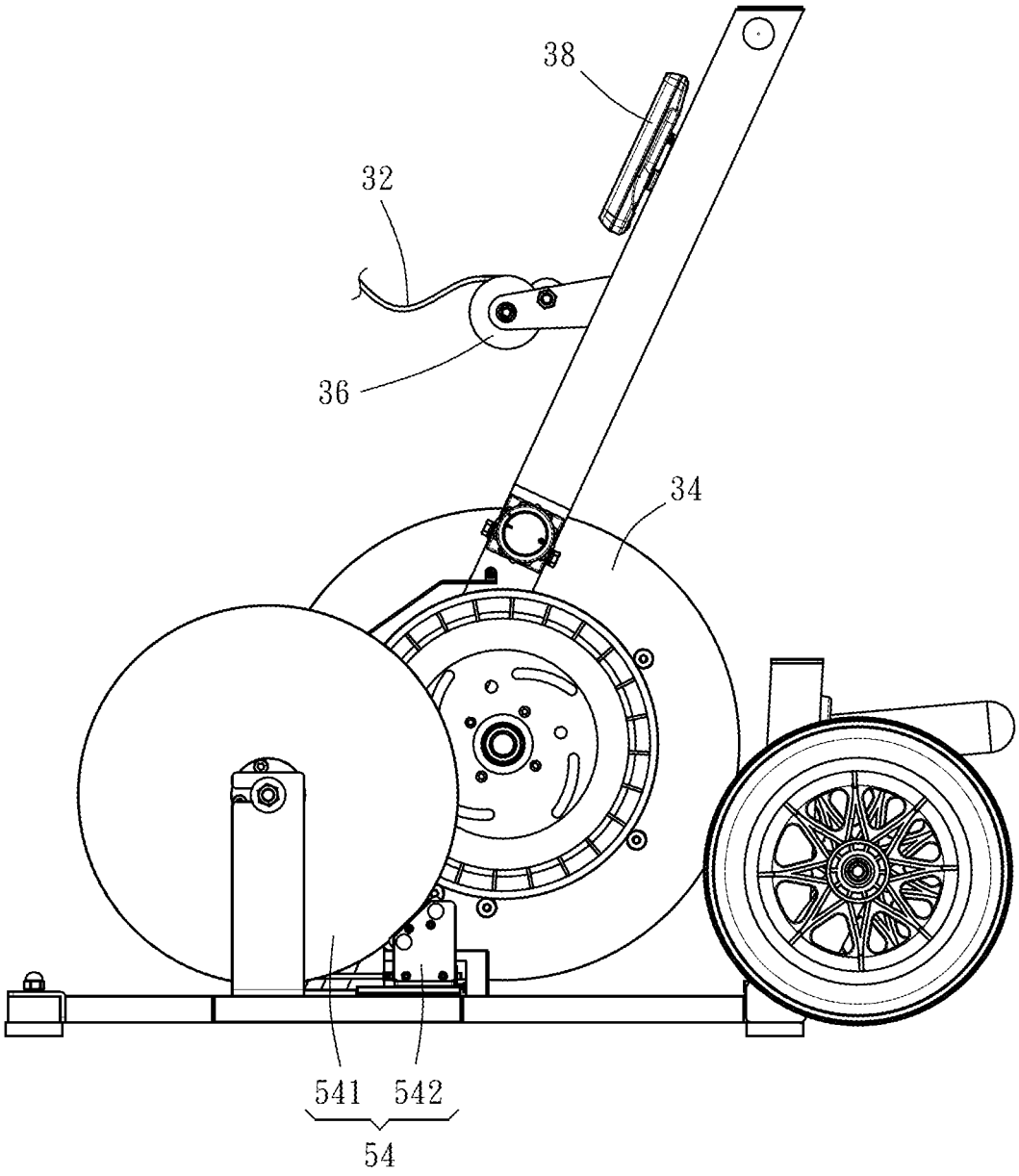
FIG. 2 is a side plain view of the towing equipment for sports in accordance with the present invention.

Referring to FIGS. 1 and 2, a towing equipment 10 comprises a support frame 20, a training unit 30, a transmission mechanism 40 and a magnetic resistance unit 50. The training unit 30 is used for user training. The transmission mechanism 40 is set on one side of the frame body 24 and connects the training unit 30 to the magnetic resistance unit 50 to transfer the kinetic energy generated by the training unit 30 to the magnetic resistance unit 50, so that the magnetic resistance unit 50 can resist the kinetic energy of the training unit 30.

The support frame 20 comprises a base 22 set on the ground and a frame body 24 vertically connected to the upper side of the base 22 for supporting the training unit 30, the transmission mechanism 40 and the magnetic resistance unit 50. The back of the base 22 of the support frame 20 is connected with a dumbbell rack 26 and a pair of moving wheels 28. The dumbbell rack 26 is for users to hang dumbbells to increase the stability of the support frame 20. The moving wheels 28 that can increase the practicality of the towing equipment 10 are combined with an armrest 27 on the upper side of the frame body 24, so that the user can move the towing equipment 10 to the training place or outdoors.

The training unit 30 comprises an elastic training belt 32 and a set of training wheels 34 mounted on the frame body 24 and used to wind the training belt 32. One end of the elastic training belt 32 is mounted with a hook 321 to hook a speed belt that has been tied to the human body, a customized vest (not shown) or any one that can be worn on the human body and hooks with the hook 321. The other end of the elastic training belt 32 is fixed and wound on the training wheel 34. A control wheel set 36 is set on the frame body 24. The control wheel set 36 comprises two working wheels 361 side by side.

The elastic training belt 32 is pulled out from the training wheel 34 and then passed through the control wheel set 36 and then tied to the human body. With the automatic retraction function of the training wheel 34, it can effectively control the retracting and unwinding of the elastic training belt 32 to avoid accidents caused by the elastic training belt 32 and prevent tangling of the elastic training belt 32. In addition, the frame body 24 is equipped with a screen display 38 to display and record the user's speed, resistance value, heartbeat index and other values.

Figure 3:
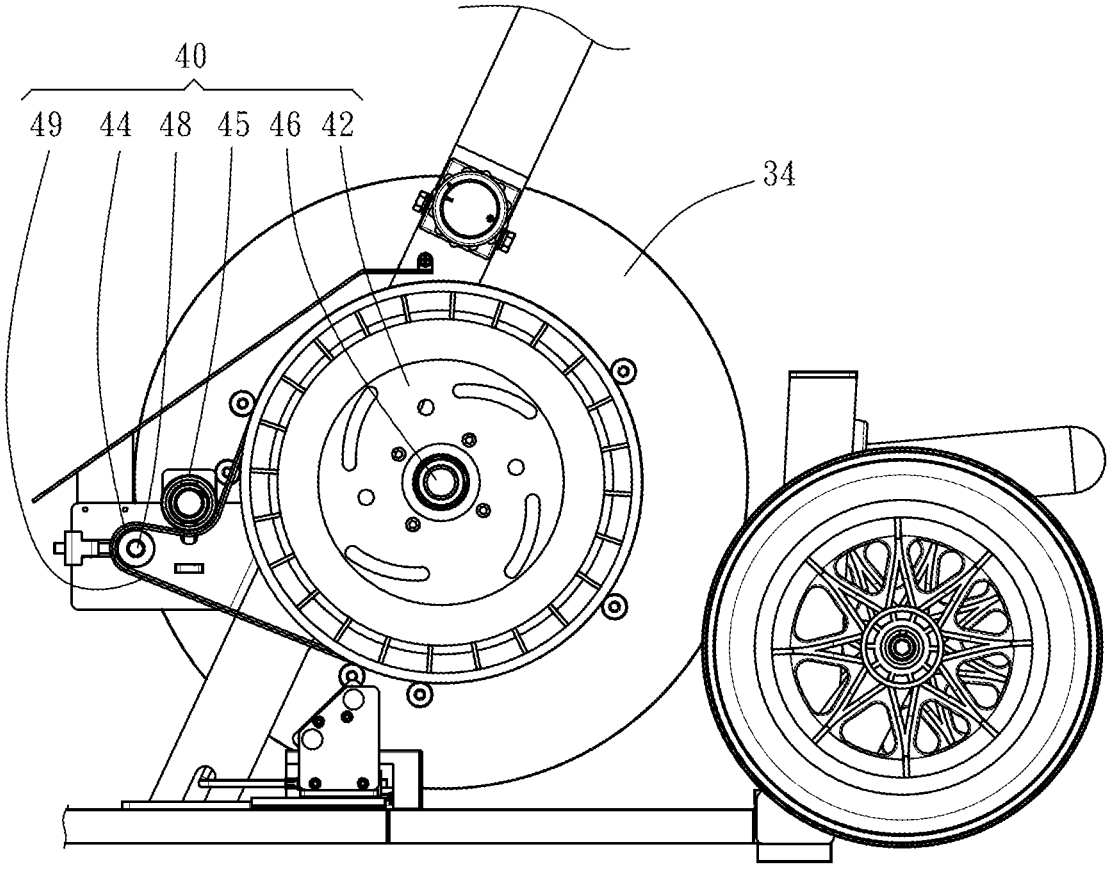
FIG. 3 is a sectional side view of a part of the towing equipment for sports, mainly showing the structure of the transmission mechanism of the towing equipment.
Figure 4:
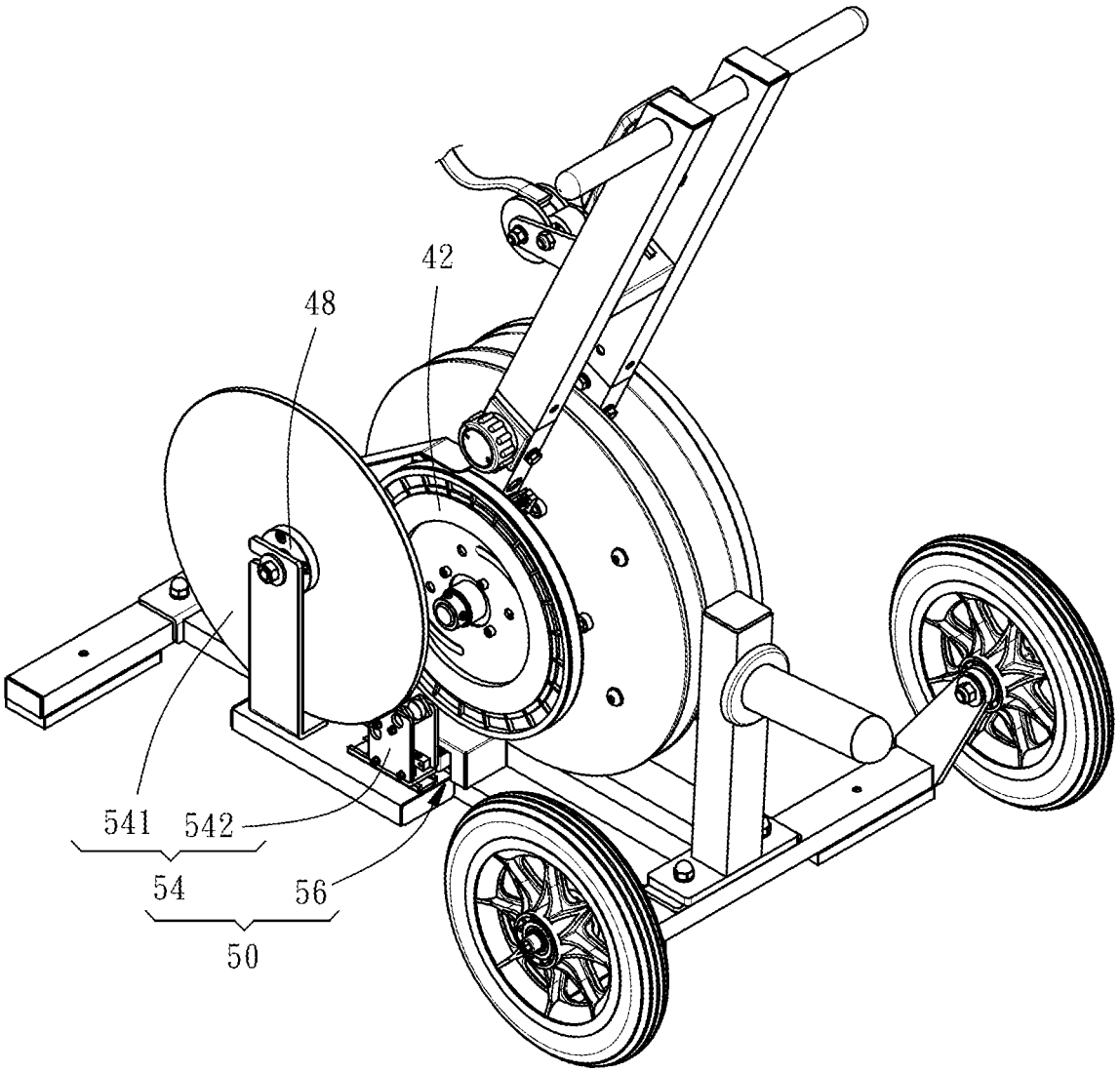
FIG. 4 is another oblique top elevational view of the towing equipment for sports, mainly showing the structure of the magnetic resistance unit of the towing equipment.
Figure 5:
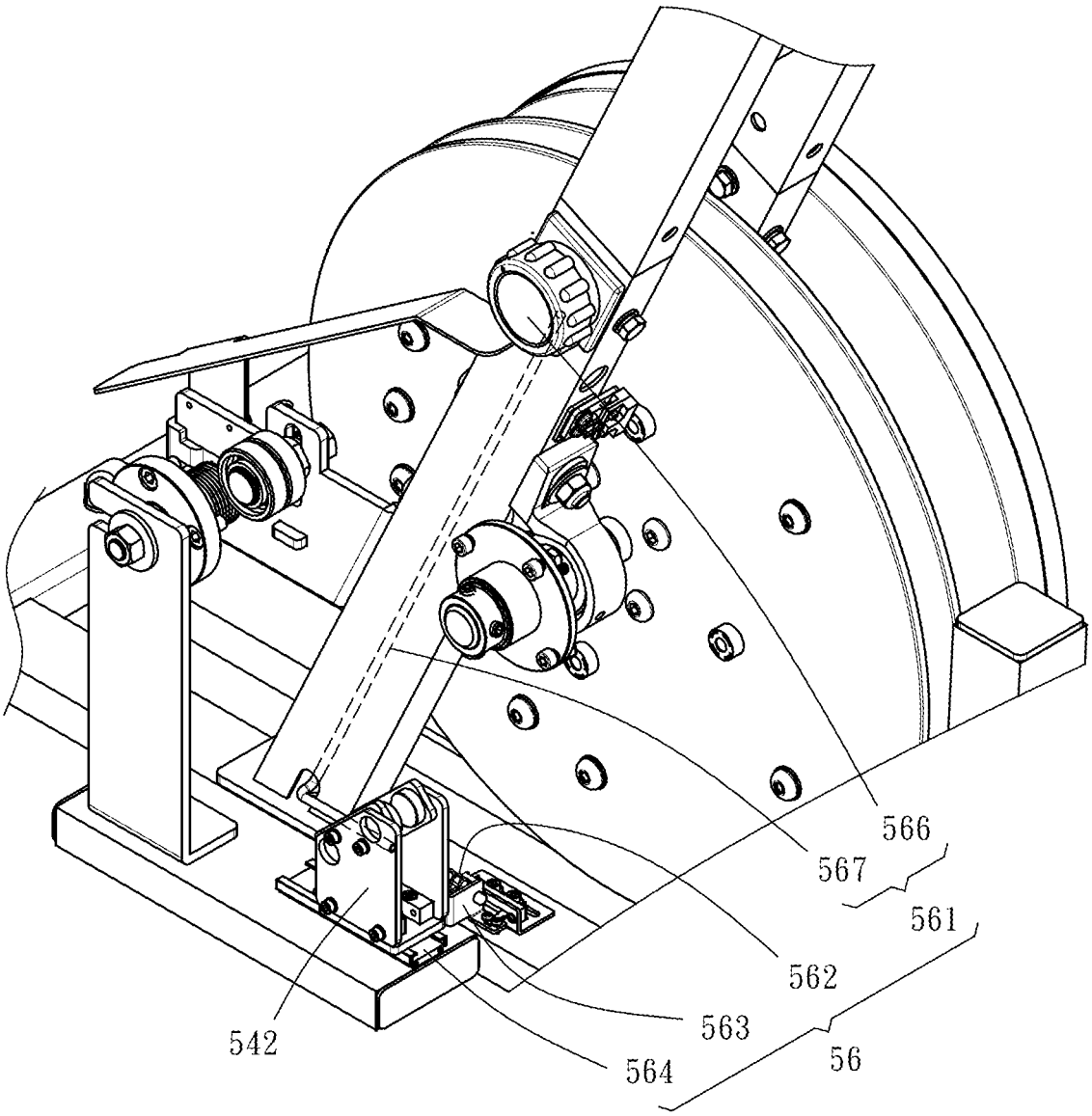
FIG. 5 is an elevational view of a part of the towing equipment for sports, mainly showing the structure of the magnetic resistance unit of the towing equipment.
Figure 6:
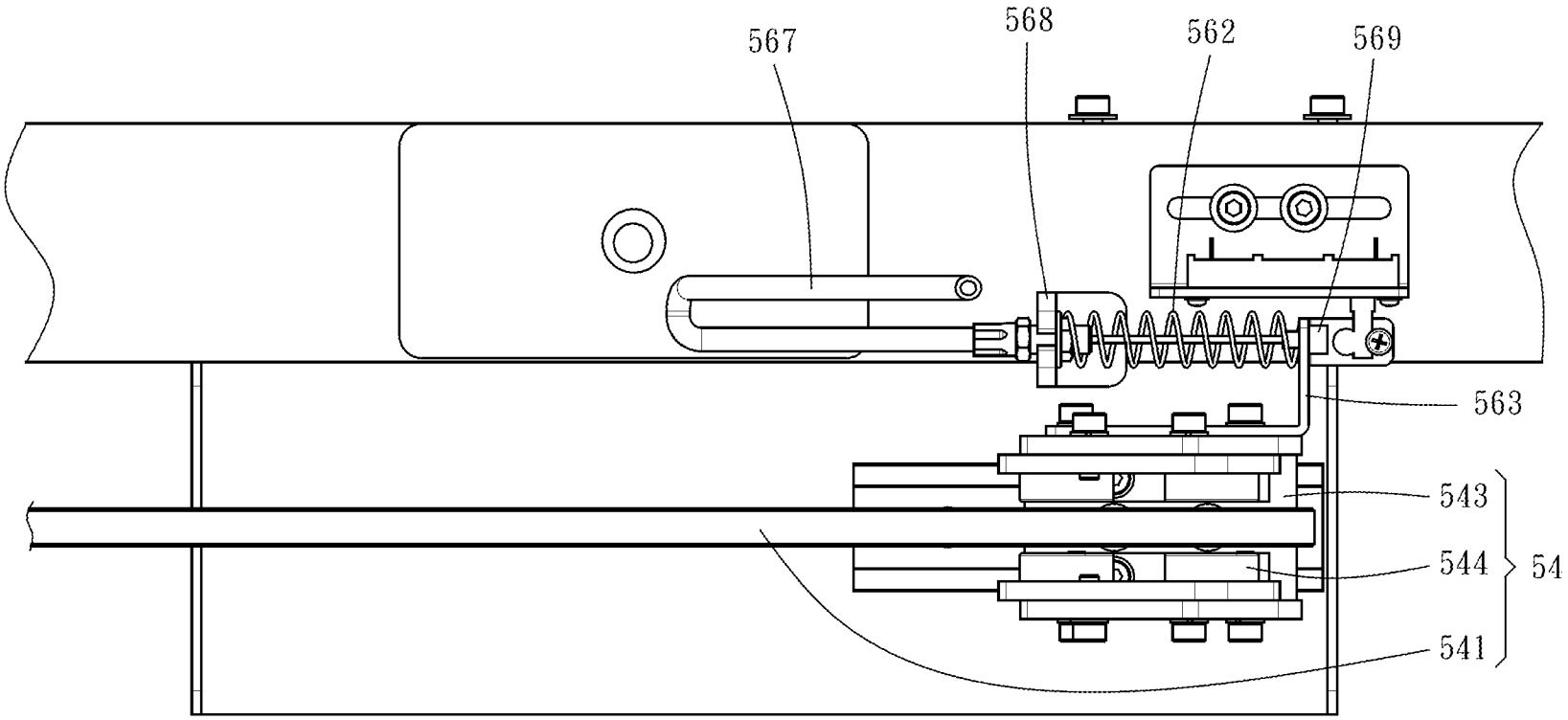
FIG. 6 is a top plain view of a part of the towing equipment for sports, mainly showing the structure of the magnetic resistance unit of the towing equipment.
Figure 7:
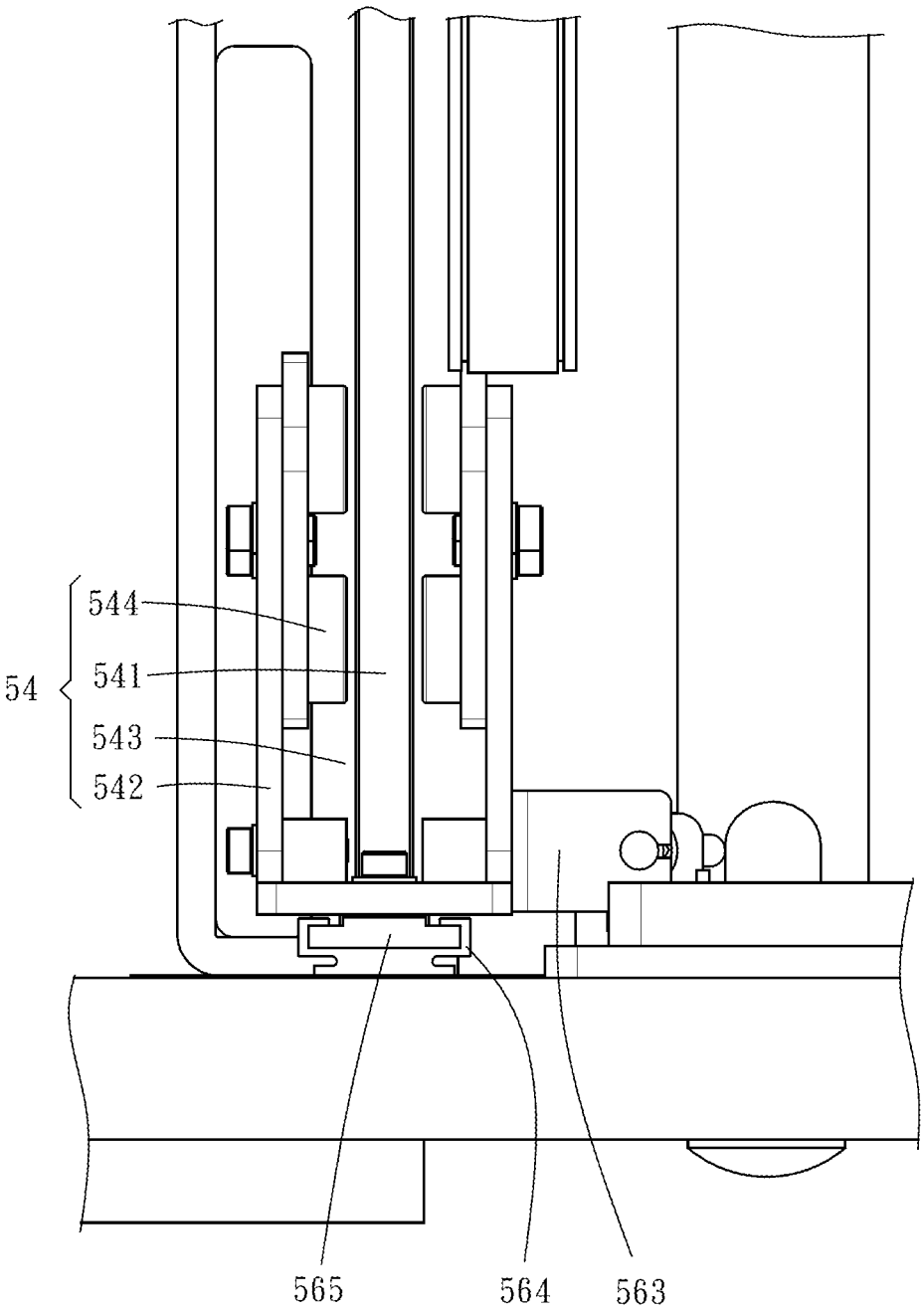
FIG. 7 is a rear plain view of a part of the towing equipment for sports, mainly showing the structure of the magnetic resistance unit of the towing equipment.

Referring to FIG. 3, the transmission mechanism 40 of the towing equipment 10 of the present preferred embodiment comprises a first transmission wheel 42, a second transmission wheel 44, a first shaft 46, a second shaft 48, a transmission member 49 and a press roller 45.

The first transmission wheel 42 is located on one side of the training wheel 34. The first shaft 46 is the shaft of both the training wheel 34 and the first transmission wheel 42. The second transmission wheel 44 is set on the second shaft 48. The transmission member 49 connects the first transmission wheel 42 and the second transmission wheel 44. The press roller 45 is set between the first transmission wheel 42 and the second transmission wheel 44, outside the transmission member 49, to adjust the tension of the transmission member 49. When the human body pulls the elastic training belt 32 to move forward, the kinetic energy generated by pulling the training wheel 34 is transmitted to the first shaft 46, and then transmitted from the first shaft 46 to the first transmission wheel 42, thereby causing the first transmission wheel 42 and the second transmission wheel 44 to rotate.

Referring to FIGS. 4-7, the magnetic resistance unit 50 of the towing equipment 10 comprises a magnetic device set 54 and an adjustment device set 56. The magnetic device set 54 comprises a resistance wheel 541, a bearing block 542 at the base 22 and a set of magnets 544. The bearing block 542 is set corresponding to the resistance wheel 541. The resistance wheel 541 is located in the frame body 24 and is set on the second shaft 48 together with the second transmission wheel 44 to connect the magnetic resistance unit 50 to the transmission mechanism 40.

In addition, the bearing block 542 has an accommodating space 543, and the accommodating space 543 accommodates the set of magnets 544. The magnets 544 arranged in a pairwise manner so that a magnetic field is formed between the magnets 544. The cooperation between the resistance wheel 541 and the bearing block 542 forms resistance. The resistance wheel 541 is made of a magnetic material. The adjustment device set 56 can effectively control the resistance.

The adjustment device set 56 comprises an adjustment member 561, an elastic member 562, a driving member 563 and a corresponding sliding groove 564 and a clamping portion 565. The adjustment member 561 comprises a rotary knob 566 and a connecting tube 567. The connecting tube 567 has one end thereof connected with the rotary knob 566 and an opposite end thereof connected to the elastic member 562. The two opposite ends of the elastic member 562 have a first end piece 568 and a second end piece 569. The second end piece 569 is located at one end of the elastic member 562 away from the connecting tube 567. The elastic member 562 can be a spring or any element that can generate force to adjust the distance between the first end piece 568 and the second end piece 569. In addition, the second end piece 569 is connected to the driving member 563, and the elastic member 562 is connected to the bearing block 542 through the driving member 563. Furthermore, the bottom of the bearing block 542 is convexly connected to the clamping portion 565, and the sliding groove 564 is disposed on the opposite side of the clamping portion 565, so that the clamping portion 565 is slidably clamped to the sliding groove 564. Adjust the adjustment member 561 to stretch or compress the elastic member 562, so that the second end piece 569 is close to or away from the first end piece 568, and then the driving member 563 is linked to drive the bearing block 542 to move back and forth on the sliding groove 564, thereby adjusting the correspondence between the bearing block 542 and the resistance wheel 541. It is worth mentioning that a balance wheel 60 is arranged on the other side of the training wheel 34, that is, the opposite side of the first transmission wheel 42 to balance the towing equipment 10. When the training wheel 34, the resistance wheel 541, the first transmission wheel 42 and the second transmission wheel 44 are running fast, it avoids the towing equipment 10 from overturning due to loss of balance.

Based on the above-mentioned structure of the towing equipment 10, the operation process of the towing equipment 10 of the present invention is as follows.

First, when the user hooks the hook 321 of the elastic training belt 32 to a speed belt worn on the body and moves in the opposite direction of the towing equipment 10, the elastic training belt 32 wound on the training wheel 34 is pulled out, the training wheel 34 is driven to produce a rotation motion on the first shaft 46. The kinetic energy is transmitted from the training wheel 34 to the first shaft 46 and drives the first transmission wheel 42 on the same shaft to rotate in the same direction, and the second transmission wheel 44 is driven by the transmission member 49 to rotate in the same direction as the first transmission wheel 42. At this time, the second shaft 48 driven by the second transmission wheel 44 drives the resistance wheel 541 to rotate in the same direction. The user can choose to pull the elastic training belt 32 out of the training wheel 34 and directly hook it to the speed belt on the human body. The taller users can choose to pass the elastic training belt 32 through the control wheel set 36 on the frame body 24, and then buckle the elastic training belt 32 to the speed belt on the human body.

The user can generate resistance to the resistance wheel 541 by adjusting the adjustment member 561. When the adjustment member 561 is rotated to increase the pressure of the resistance wheel 541, the adjustment member 561 will pull the elastic member 562 to a compressed state. At this time, the first end piece 568 and the second end piece 569 are close to each other, and then drive the driving member 563 to link the bearing block 542, so that the bearing block 542 slides on the sliding groove 564 in the direction of the resistance wheel 541. Conversely, when the adjustment member 561 is rotated to reduce the pressure of the resistance wheel 541, the adjustment member 561 will push the elastic member 562 to a stretched state. At this time, the second end piece 569 is far away from the first end piece 568, and then drives the driving member 563 to interlock with the bearing block 542, so that the bearing block 542 slides on the sliding groove 564 and moves away from the resistance wheel 541. The resistance is controlled by the overlap area of the magnetic field cut through the bearing block 542 when the resistance wheel 541 rotates. When the resistance wheel 541 and the bearing block 542 are close to each other, the overlap area between them is larger, and the resistance generated is greater. When the resistance wheel 541 and the bearing block 542 are far away from each other, the overlap area between them is smaller, and the resistance generated is smaller.

In summary, the towing equipment 10 disclosed in the present invention combines the adjustable magnetic resistance unit 50 to provide users with speed and strength enhancement training. The transmission mechanism 40 connects the training wheel 34 with the magnetic resistance unit 50. Resistance is generated through the magnetic resistance unit 50. By controlling the adjustment member 561, the bearing block 542 is displaced relative to the resistance wheel 541 that rotates, and the overlap area between the bearing block 542 and the resistance wheel 541 is changed, thereby controlling the resistance generated when the resistance wheel 541 cuts through the magnetic field of the bearing block 542.

What is claimed is:

1. A towing equipment for sports, comprising a support frame, a training unit, a magnetic resistance unit and a transmission mechanism, wherein:

said support frame comprises a base and a frame body connected to said base in an upright position;

said training unit is set in said frame body, said training unit comprising a training wheel and an elastic training belt, said elastic training belt having one end thereof wound on said training wheel and an opposite end thereof connectable to the user;

said transmission mechanism is set in said frame body, said transmission mechanism connecting said training unit and said magnetic resistance unit; and said magnetic resistance unit comprises a magnetic device set and an adjustment device set, said magnetic device set comprising a resistance wheel, a bearing block and first and second sets of magnets, said resistance wheel being set in said frame body, said bearing block being set corresponding to said resistance wheel, said bearing block including a first wall having the first set of magnets, a second wall facing the first wall and having the second set of magnets, and a base section connected to the first wall and the second wall, the resistance wheel being sandwiched by the first wall and the second wall of the bearing block, the base section of the bearing block arranged to slide on the base of the support frame, said first and second set of magnets forming a magnetic field, said adjustment device set being connected to said magnetic device set and used to change an area of overlap between said resistance wheel and said bearing block;

wherein the kinetic energy generated by the user pulling said elastic training belt is transmitted to said resistance wheel through said transmission mechanism, and a resistance is generated by said magnetic field that cuts through said bearing block when said resistance wheel rotates;

wherein said adjustment device set of said magnetic resistance unit comprises an adjustment member, an elastic member and a driving member, said adjustment member being connected with said elastic member, said driving member being connected between said elastic member and said bearing block, said elastic member driving said driving member to adjust the correspondence between said bearing block and said resistance wheel by means of adjusting said adjustment member to stretch or compress said elastic member, thereby causing the base section of the bearing block to slide on the base of the support frame.

2. The towing equipment as claimed in claim 1, wherein said adjustment device set further comprises a sliding groove adjacent to said bearing block and a clamping portion, said clamping portion being set between said bearing block and said sliding groove, said clamping portion being clamped to said sliding groove, so that said bearing block is moved back and forth on said sliding groove when said bearing block is driven by said driving member.

3. The towing equipment as claimed in claim 1, wherein said resistance wheel is made of a magnetic material.

4. The towing equipment as claimed in claim 1, wherein said transmission mechanism comprises a first transmission wheel, a second transmission wheel, a first shaft, a second shaft and a transmission member, said first transmission wheel and said training wheel being co-located on said first shaft, said second shaft being the common rotating shaft of said second transmission wheel and said resistance wheel, said first transmission wheel being connected to said second transmission wheel through said transmission member.

5. The towing equipment as claimed in claim 1, wherein said transmission mechanism further comprises a press roller adjacent to said second transmission wheel for controlling the tension of said transmission member.

6. The towing equipment as claimed in claim 1, wherein said training unit further comprises a control wheel set mounted in said frame body; said elastic training belt passes through said control wheel set after being pulled out from said training wheel.

7. The towing equipment as claimed in claim 1, wherein said frame body is provided with a screen display that is used to display resistance value, heartbeat index and sprint speed.

8. The towing equipment as claimed in claim 1, wherein said base has one side thereof equipped with at least one moving wheel to facilitate the movement of the towing equipment.

9. The towing equipment as claimed in claim 1, wherein said support frame has one side thereof equipped with a dumbbell rack.

* * * * *